US008038315B1

(12) United States Patent
Santoro et al.

(10) Patent No.: US 8,038,315 B1
(45) Date of Patent: Oct. 18, 2011

(54) LUMINAIRE HOUSING WITH PRINTED BOTTOM PANEL

(76) Inventors: Scott R. Santoro, Delta (CA); Steven Johns, Vancouver (CA)

( * ) Notice: Subject to any disclaimer, the term of this patent is extended or adjusted under 35 U.S.C. 154(b) by 312 days.

(21) Appl. No.: 12/479,730

(22) Filed: Jun. 5, 2009

(51) Int. Cl.
*F21S 4/00* (2006.01)

(52) U.S. Cl. ..... 362/224; 362/217.05; 362/222; 362/307; 362/311.04

(58) Field of Classification Search ..... 362/217.05, 362/217.08, 217.09, 221–224, 307, 311.01, 362/311.04, 311.14
See application file for complete search history.

(56) References Cited

U.S. PATENT DOCUMENTS 6,471,388 B1 * 10/2002 Marsh ..... 362/217.05
7,093,955 B2 * 8/2006 Sejkora et al. ..... 362/223

* cited by examiner

*Primary Examiner* — Stephen F Husar

(57) ABSTRACT

A luminaire housing with a printed bottom panel is provided. The luminaire housing has a luminaire housing frame. The printed bottom panel is coupled to the luminaire housing frame and has a first surface generally facing the interior of the luminaire housing. The first surface of the printed bottom panel has an opaque ink layer applied thereto that defines a printed area. The printed area outlines at least one light permeable light passageway.

20 Claims, 5 Drawing Sheets

LUMINAIRE HOUSING WITH PRINTED BOTTOM PANEL

CROSS-REFERENCE TO RELATED DOCUMENTS

Not Applicable.

BACKGROUND

1. Field of the Invention

This invention pertains generally to a luminaire housing, and more particularly to a luminaire housing with a printed bottom panel.

2. Description of the Related Art

Luminaire housings often have a luminaire housing frame constructed from plastic, extruded metal, or other material. The luminaire housing frame may define one or more light exit openings through which light from a light source located interiorly of the luminaire housing frame may exit to illuminate a desired area. The light openings may include downlight, uplight, and/or sidelight openings. One or more lenses or louvers may be placed adjacent the light exit opening(s) to limit glare from the light source and/or to alter characteristics of light from the light source prior to the light illuminating the desired area.

Many such luminaire housings may be non-aesthetically pleasing. For example, such luminaire housings may contain unsightly edges and junction points visible to a user that may be formed at junctures of luminaire housing components such as lenses, baffles, and/or luminaire housing frames. Also, for example, such luminaire housings may contain lenses or baffles which have a rugged industrial look.

SUMMARY OF THE INVENTION

Brief Description of the Illustrations

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
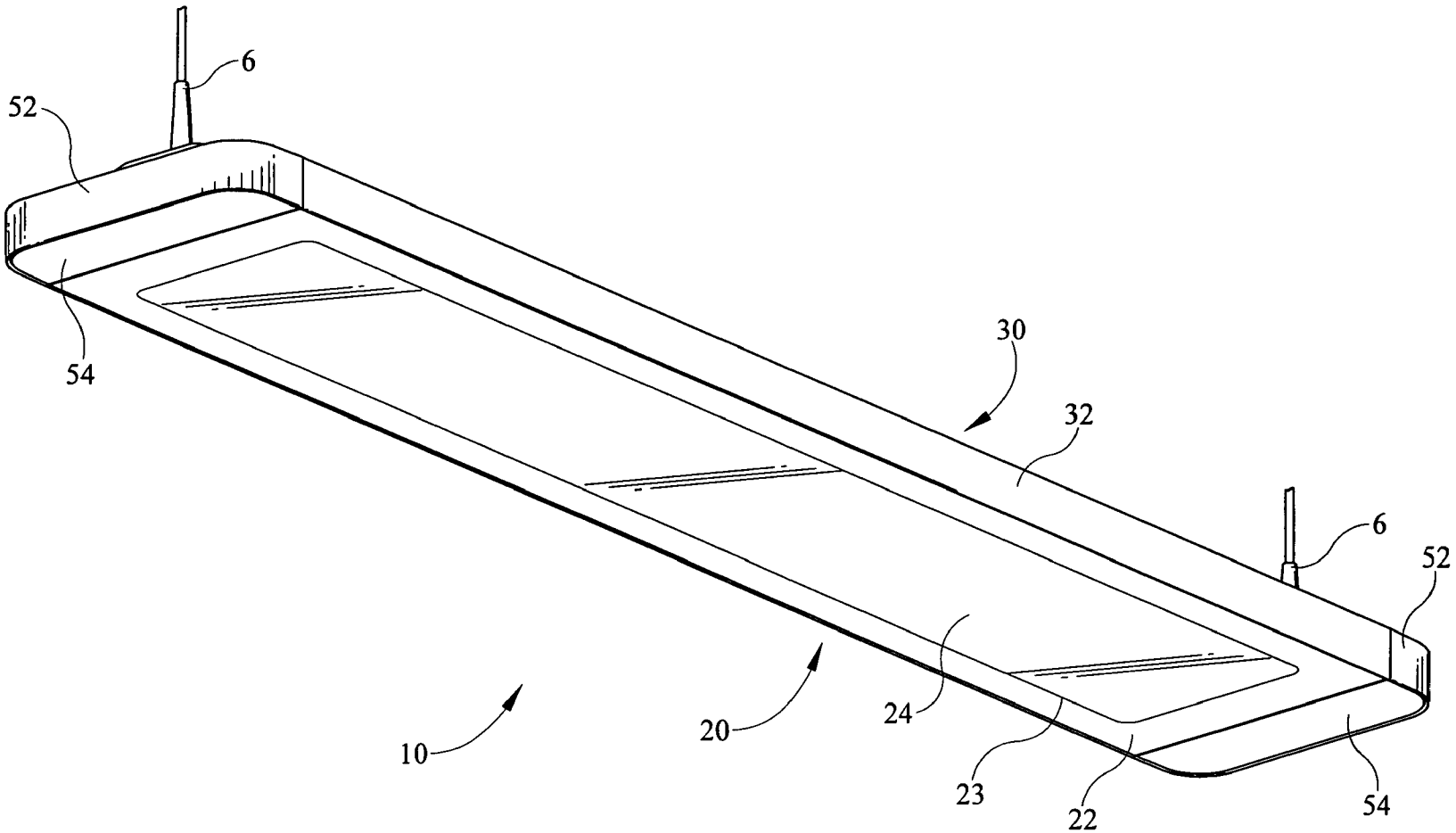
FIG. 1 is a bottom perspective view of an embodiment of a luminaire housing.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now to FIG. 1 through FIG. 5, wherein like numerals refer to like parts, various aspects of a luminaire housing 10 are shown. Luminaire housing 10 has a light permeable bottom panel 20 shown in FIG. 1 and FIGS. 3-5. The light permeable bottom panel 20 may be a polycarbonate panel that is substantially transparent in its original unpainted state. In some embodiments the polycarbonate panel may be a PALSUN® UV2 Flat Solid Polycarbonate Sheet having a thickness of approximately 1.5 millimeters, a length of approximately 48 inches, a width of approximately 7.75 inches, and a light transmission of approximately 90%. In some embodiments the polycarbonate panel may be a PALSUN® UV2 Flat Solid Polycarbonate Sheet having a thickness of approximately 1.5 millimeters, a length of approximately 96 inches, and a width of approximately 7.75 inches.

The bottom panel 20 has an opaque ink printed area 22 applied thereto that outlines a light permeable light passageway 24 in bottom panel 20. Border 23 represents the border between the printed area 22 and the light passageway 24. In other embodiments multiple light passageways, borders, and/or printed areas may be formed in bottom panel 20. For example, a thin ink printed line may be located interiorly of, and offset slightly from, border 23, creating two printed areas (one being the thin printed line and the other being exterior to the border 23) and two light passageways (one light passageway being between the border 23 and the thin printed line and the other being interior to the thin printed line). Also, for example, a solid square printed area may be located interiorly of border 23 and interiorly of light passageway 24, creating two printed areas (one being the solid square printed area and the other being exterior to the border 23) and one light passageway (the area that is interior to border 23 and surrounds the square printed area). In the depicted embodiment the light passageway 24 is completely free of screen printing, but the light passageway 24 may alternatively be lightly printed such that it still is light permeable.

The printed area 22 may be created by applying one or more layers of ink to the interior facing side of the bottom panel 20 using a desired process. The interior facing side of the bottom panel 20 is the side of the panel that will not typically be directly visible by a user, or, in other words, the side of the panel that generally faces the interior portion of the luminaire housing 10 and any light source that may be installed within the luminaire housing 10. The process used to apply one or more layers of ink may be a large format screen printing process that applies at least two layers of ink to ensure the printed area of the bottom panel 20 is opaque. In certain embodiments when a black printed area is desired two layers of black ink may be applied to ensure the printed area of the bottom panel 20 is opaque. In other embodiments when a white printed area is desired two layers of white ink may be first applied followed by a black layer atop the two white layers to ensure the printed area of the bottom panel 20 is opaque while still appearing white when viewed from the bottom side/exterior facing side of bottom panel 20. Alternative processes may be used to apply one or more layers of ink to bottom panel 20 as is known to those in the art. Such processes include, for example, digital flat bed printing, inkjet printing, and plate printing.

With particular reference to FIGS. 2 through 5, the depicted embodiment of luminaire housing 10 is an elongated luminaire housing having a luminaire housing frame 30 with two longitudinally extending luminaire housing frame sides 32 and two latitudinally extending end plates 34. The frame sides 32 and end plates 34 surround an interior portion of the luminaire housing 10. The depicted housing frame sides 32 are extruded aluminum and flank the interior portion of the luminaire housing 10. The end plates 34 extend between opposite ends of frame sides 32, coupling the frame sides 32 to one another. The end plates 34 may be slidably coupled to the frame sides 32.

The depicted end plates 34 support a ballast housing having a ballast housing top piece 42 and a ballast housing bottom piece 43. The ballast housing extends longitudinally between the end plates 34 and may enclose one or more ballasts or power supplies for powering a light source. For example, the ballast housing may enclose one or more electronic ballast for powering 2 T5 fluorescent lamps or 2 T5HO fluorescent lamps. Reflective mirror finish pieces 34 may be placed over portions of the ballast housing to help reflect light from fluorescent bulbs 2 in a generally upward direction and/or to provide a clean visual appearance. Top piece 42 and bottom piece 43 may be extruded aluminum and reflective mirror finish pieces 34 may be polished extruded aluminum.

Figure 2:
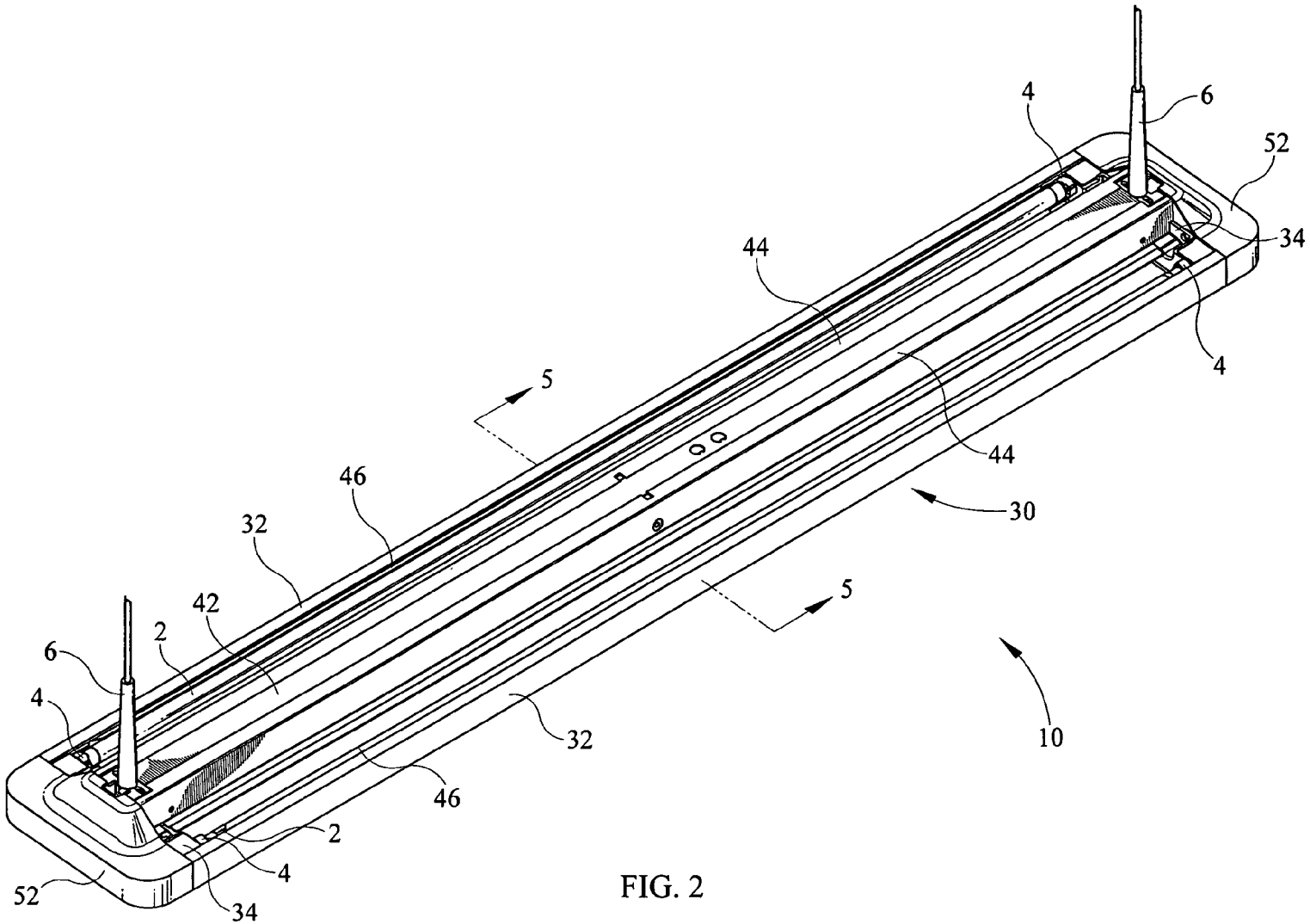
FIG. 2 is a top perspective view of the embodiment of the luminaire housing of FIG. 1.
Figure 3:
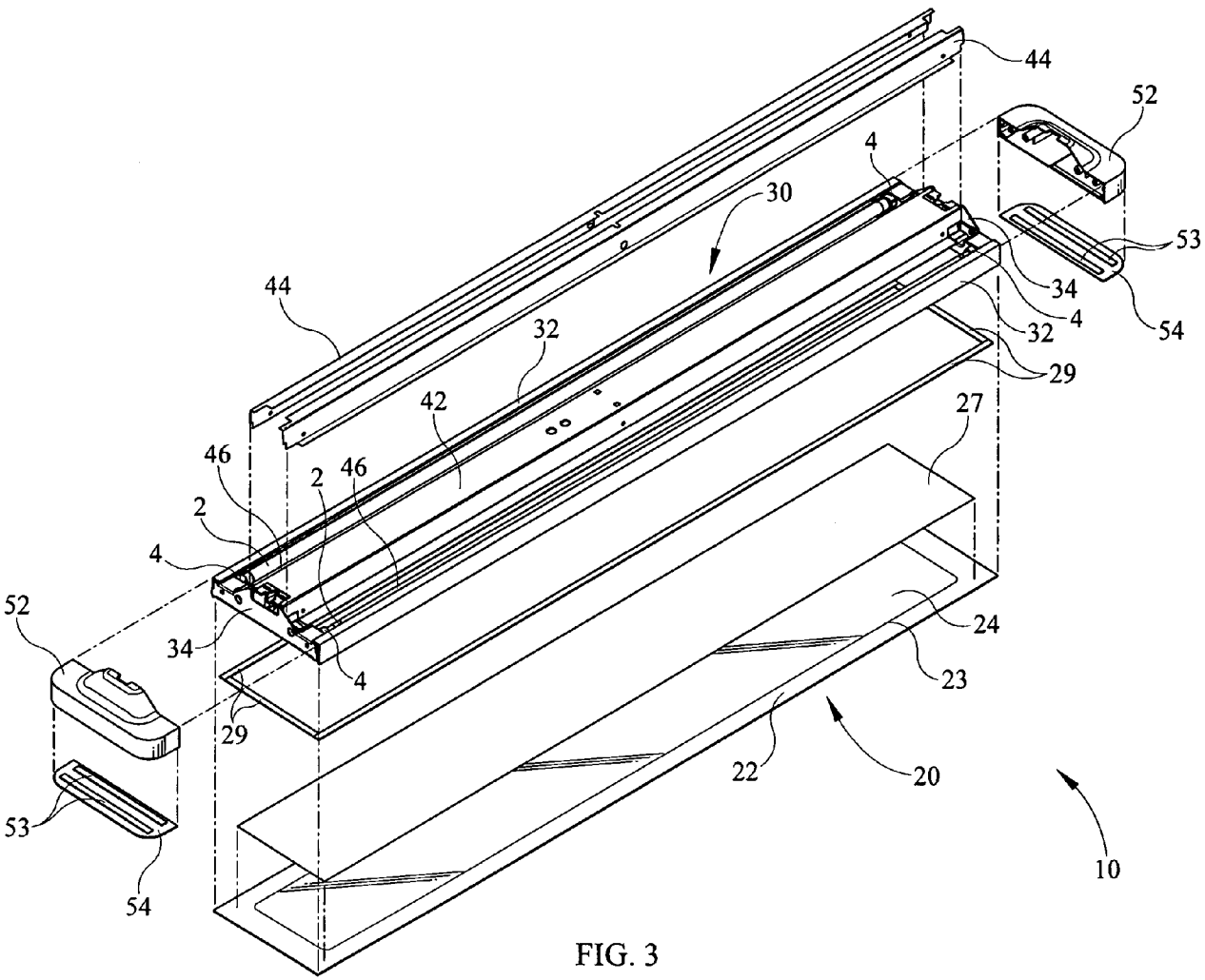
FIG. 3 is a partially exploded top perspective view of the embodiment of the luminaire housing of FIG. 1.

The depicted end plates 34 also contain apertures and screw holes for mounting a pair of attachment support brackets and air craft cables 6, which are visible in FIGS. 1, 2, and 3. The support brackets and cables 6 may be used to suspend the luminaire housing 10 from an installation surface. In other embodiments the luminaire housing 10 may be directly or otherwise installable to an installation surface. The depicted end plates 34 also contain apertures for coupling the end caps 52 to the end plates 34 at the latitudinal sides of the luminaire housing frame 30. The depicted end plates 34 also support sockets 4, which may removably receive fluorescent bulbs 2. The sockets 2 and bulbs 4 are visible in FIGS. 2 through 5. Partially surrounding each fluorescent bulb 2 is a reflector 46 that reflects a majority of light output from each fluorescent bulb 2 in an upward direction away from bottom panel 20. In some embodiments the reflectors 46 are Miro IV® specular reflectors that provide a generally wide-spread upwardly directed batwing distribution when paired with a fluorescent bulb. In the depicted embodiment the luminaire housing is configured to provide approximately 70% uplighting and 30% downlighting. In alternative embodiments reflectors may be installed between the reflective mirror finish piece(s) 44 and the reflectors 46 to provide more downlighting, such as 80% downlighting or 100% downlighting. The end plates 34 may be die-cast aluminum.

Luminaire housing frame 30 has been shown and described in detail herein. However, it is noted that in alternative embodiments of luminaire housing 10, alternative luminaire housing frames may be utilized. For example, luminaire housing frames may be utilized that are configured to surround non-fluorescent light sources and/or are configured to support no reflectors, or alternative reflectors than those described herein. Also, for example, luminaire housing frames may be used that omit end plates 34 and allow for direct attachment of end caps 52 to housing frame sides 32. Also, for example, luminaire housing frames may be used that utilize non-linear end plates and/or sides. One skilled in the art will realize that other alternative housing frames 30 may be utilized.

End caps 52 are provided on latitudinal sides of the luminaire housing frame 30. The end caps 52 each have an end cap printed panel 54 coupled to a bottom surface thereof. The end cap printed panel 54 may be a polycarbonate panel and in some embodiments the polycarbonate panel may be a PALSUN® UV2 Flat Solid Polycarbonate Sheet having a thickness of approximately 1.5 millimeters. The end cap printed panels 54 in the depicted embodiment are substantially coplanar with the bottom panel 20 and are located immediately adjacent the bottom panel 20. In the depicted embodiments the entirety of the end cap printed panels 54 are printed with at least one layer of ink on an interior facing side of the end cap printed panels 54 using a desired printing process. In some embodiments the printing process is a screen printing process. In some embodiments enough layers of ink are applied to make the ink printed portions of the printed panels 54 opaque. The interior facing side of each of the end cap printed panels 54 is the side which is not directly visible by a user, or, in other words, the side which faces generally toward the interior of the respective end cap 52 and faces the same general direction as the interior side of the bottom panel 20. The end caps 52 may be die-cast aluminum in some embodiments.

Optionally, the end caps 52 may be removed from the luminaire housing frame 30 to allow multiple luminaire housing frames 30 to be installed in a row in a latitudinal end to latitudinal end relationship. Multiple luminaire housing frames may be installed in a row utilizing joiner aligners insertable in the ends of frame sides 32, or otherwise. Once multiple luminaire housing frames 30 have been joined to one another, end caps 52 may be attached at the outermost latitudinal ends of the joined luminaire frames 30. When multiple luminaire housing frames 30 have been joined together the bottom panels 20 of adjoining luminaire housing frames 30 will be in a substantially coplanar arrangement. Moreover, where each luminaire housing frame 30 is joined to another luminaire housing frame 30, a latitudinal end of one bottom panel 20 will be immediately adjacent a latitudinal end of the adjacent bottom panel 20. The immediate adjacency of the latitudinal ends of the bottom panels 20 and the substantially coplanar relationship between the two adjacent bottom panels 20 may create a smooth uninterrupted appearance at the intersection between the two bottom panels 20.

To join two luminaire housing frames 30 to one another in one embodiment, an end cap 52 may be removed from a latitudinal end of each of the two luminaire housing frames 30. Joiner aligners may then be partially inserted at the end cap free ends of frame sides 32 in slots (shown in FIG. 5) of the frame sides 32 of a first of the luminaire housing frames 30. The slots may include the substantially T shaped slots in the upper exterior corner of the frame sides 32. A portion of the joiner aligners will be left extending out from the end cap free ends of the frame sides 32 of the first of the luminaire housing frames 30. The matching slots in the end cap free ends of the frame sides 32 of the second of the luminaire housing frames 30 can then be slid over the exposed portion of the joiner aligners, causing the two luminaire housing frames 30 to be joined to one another. Bolts may then be inserted through apertures in the two adjoining end plates 34 and nuts tightened on the bolts to further secure the two luminaire housing frames 30 to one another. One or more brackets coupled to each of the two adjoining end plates 34 may also be used.

The end cap screen printed panels 54 and the screen printed area 22 of the bottom panel 20 may be printed with common and/or similar colors of ink. The common colors of ink and/or the substantial coplanar arrangement of the screen printed panels 54 and the bottom panel 20 may create a smooth uninterrupted appearance at the intersection between the end caps 52 and the bottom panel 20. A smooth uninterrupted appearance may also be present at the intersection of the light passageway 24 and the screen printed area 22 due at least in part to the two areas being formed from a single polycarbonate panel. Application of the ink to the interior surface of the screen printed panels 54 and the bottom panel 20 creates an aesthetically pleasing glossy transparent appearance. All or portions of the end caps 52 and/or all or portions of the luminaire housing sides 32 may be painted a common and/or similar color as the end cap screen printed panels 54 and the screen printed area 22 of the bottom panel 20 to create a smooth uninterrupted appearance for most visible portions of the luminaire housing 10. In some embodiments the luminaire housing sides 32 and the end caps 52 may be coated with an electrostatically applied and thermally cured powder coat paint finish.

Figure 4:
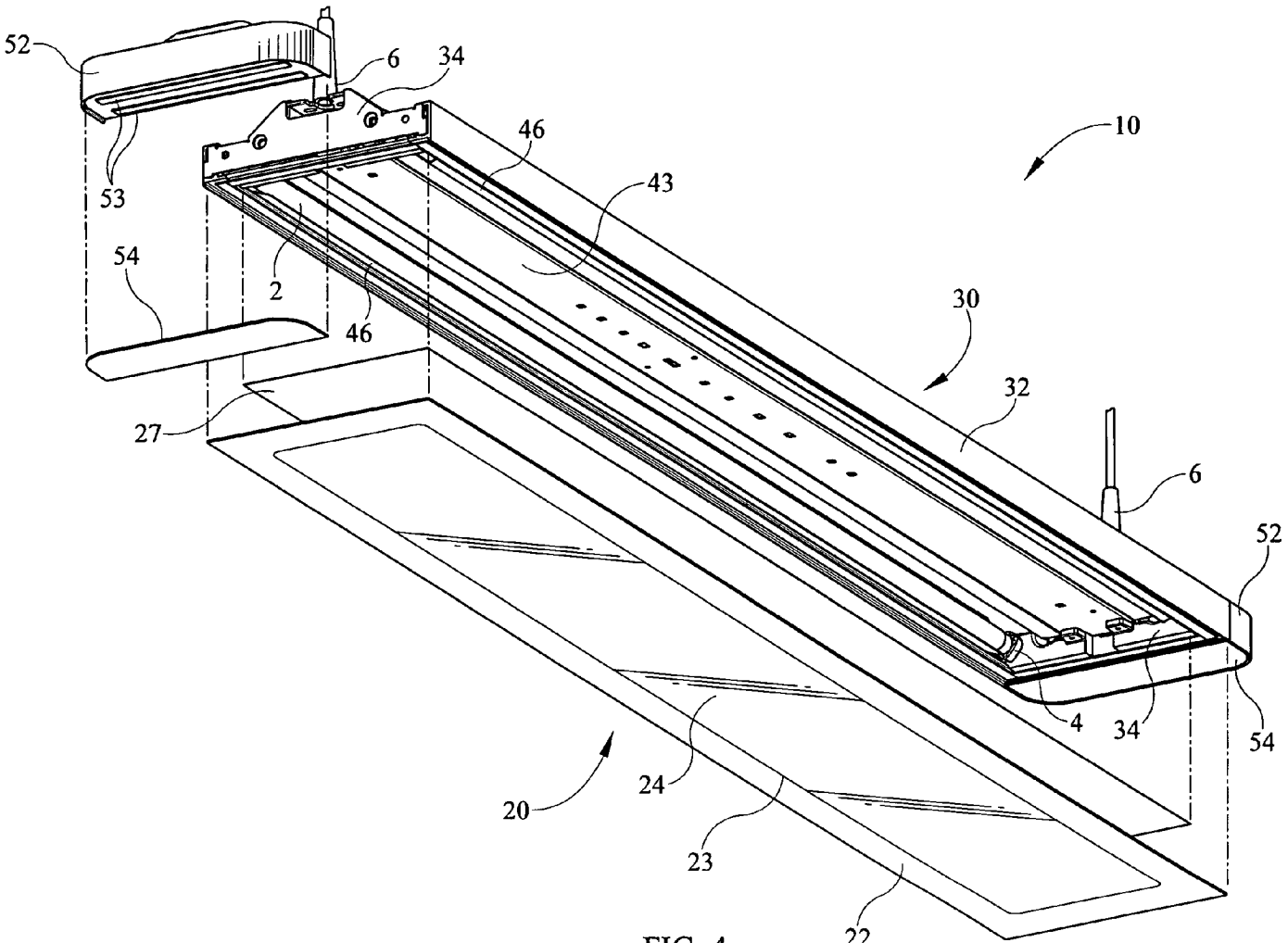
FIG. 4 is a partially exploded bottom perspective view of the embodiment of the luminaire housing of FIG. 1.
Figure 5:
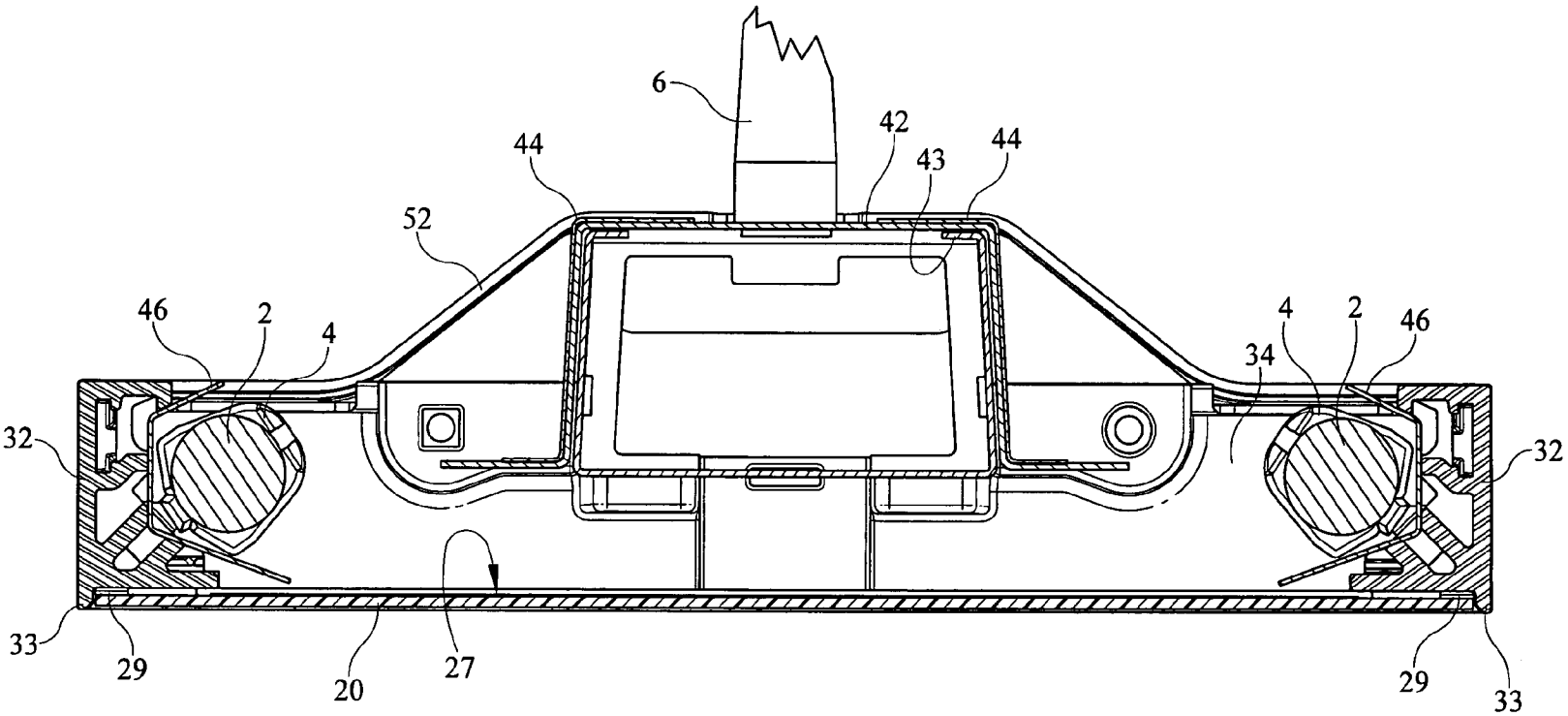
FIG. 5 is a sectional view of the embodiment of the luminaire housing of FIG. 1 taken along the section line 5-5 of FIG. 2.

With particular reference to FIGS. 3 through 5, strips of end cap adhesive tape 53 may be used to couple the end cap printed panels 54 to the end caps 52. Strips of bottom panel adhesive tape 29 may be used to couple bottom panel 20 to luminaire housing frame 30. In some embodiments the strips of end cap adhesive tape 53 and the strips of bottom panel adhesive tape 29 are 3M™ VHB™ 5958FR tape. A diffuser 27 is also visible in FIGS. 3 through 5. Diffuser 27 is placed on the interior facing side of bottom panel 20, over and covering light passageway 24. Diffuser 27 diffuses any light from any fluorescent bulbs 2 prior to the light passing through light passageway 24. During assembly of the luminaire housing 10, the bottom panel 20 may be electrostatically charged prior to diffuser 27 being placed on the interior facing side of bottom panel 20 in order to at least temporarily electrostatically adhere the diffuser 27 to bottom panel 20. In the depicted embodiment when luminaire housing 10 is assembled, diffuser 27 will not be mechanically coupled to the luminaire housing, allowing for expansion and contraction of diffuser 27. Diffuser 27 will however be maintained in position within luminaire housing 10 by virtue of being bounded by bottom panel 20, housing frame sides 32, and housing end plates 34. In some embodiments the diffuser 27 is a LedaLite MesaOptics™ diffuser.

With particular reference to FIG. 5, it can also be seen that in the depicted embodiment a lip portion 33 of housing sides 32 is immediately adjacent to the longitudinal sides of bottom panel 20. The lip portion 33 may help maintain bottom panel 20 in position and may allow the bottom panel 20 to be substantially coplanar with the bottom facing edge of housing sides 32, enabling a smooth uninterrupted appearance between bottom panel 20 and housing sides 32. With particular reference to FIG. 4, it can be seen that end caps 52 likewise have a lip that allows the end cap panels 54 to be substantially coplanar with the bottom facing edge of end caps 52, enabling a smooth uninterrupted appearance between end caps 52 and end cap panels 54.

The foregoing description has been presented for purposes of illustration. It is not intended to be exhaustive or to limit the invention to the precise forms disclosed, and obviously many modifications and variations are possible in light of the above teaching. It is understood that while certain forms of the invention have been illustrated and described, it is not limited thereto except insofar as such limitations are included in the following claims and allowable functional equivalents thereof.

We claim:

1. A luminaire housing, comprising:

a luminaire housing frame surrounding an interior portion of said luminaire housing;

at least one longitudinally extending lamp in said housing frame, said housing frame having a ballast housing top piece;

said lamp at least partially surrounded by a reflector within said housing frame;

a light permeable polycarbonate silk screened bottom panel positioned below a diffuser, said bottom panel and said diffuser coupled to said luminaire housing frame below said at last one longitudinally extending lamp, said diffuser panel covering at least one light permeable light passageway;

said housing frame having a first and a second end plate on distal ends of said housing frame, each of said end plates having an end cap removably affixed and having an end cap panel;

said bottom panel having a first silk screened surface generally facing said interior portion of said luminaire housing and a second surface opposite said first surface, said second surface having a glossy transparent appearance; wherein said first surface has an opaque ink layer applied to a portion thereof, said opaque ink layer defining a printed area; and wherein said opaque printed area outlines said at least one light permeable light passageway in said bottom panel.

2. The luminaire housing of claim 1, further comprising a second longitudinally extending lamp and a first and a second reflector mirror finish piece extending longitudinally along said frame in opposite alignment with said first and said second longitudinally extending lamps.

3. The luminaire housing of claim 2, wherein said at least one reflector partially surrounds said lamp to provide both uplight and downlight, said reflector reflecting light through said at least one light permeable light passageway in said bottom panel and also reflecting light towards said associated reflector mirror finish piece.

4. The luminaire housing of claim 3, wherein said diffuser panel contacts and rests atop said first surface.

5. The luminaire housing of claim 3, wherein said luminaire housing bottom panel is a single continuous polycarbonate panel extending between said first end cap and said second end cap.

6. The luminaire housing of claim 2, wherein said light permeable light passageway is substantially ink-free.

7. A luminaire housing, comprising:

a luminaire housing frame having a pair of sidewalls in spaced relation to one another flanking an interior portion of said luminaire housing;

a first and second end cap coupled to said luminaire housing frame, said first end cap located at a first end of said sidewalls and said second end cap located at a second end of said sidewalls opposite said first end;

a first and a second longitudinally extending lamp in said luminaire housing extending between said first and second end cap;

a first and a second reflector respectively surrounding said first and said second lamp, each of said reflectors at least partially surrounding said respective lamp;

a continuous light permeable bottom panel extending between said longitudinally extending sidewalls, said first end cap, and said second end cap;

said bottom panel having a first surface generally facing said interior portion of said luminaire housing and a second surface opposite said first surface;

wherein said first surface of said bottom panel has at least one layer of ink applied to a portion thereof, said at least one layer of ink defining at least one substantially opaque printed area; and wherein said printed area outlines at least one light permeable light passageway in said bottom panel.

8. The luminaire housing of claim 7, further comprising a diffuser panel adjacent said first surface of said bottom panel, said diffuser panel covering said light permeable light passageway.

9. The luminaire housing of claim 8, wherein said bottom panel is polycarbonate.

10. The luminaire housing of claim 9, wherein said at least one layer of ink is a silk screen layer of ink.

11. The luminaire housing of claim 10, wherein said silk screen layer of ink comprises at least two of said at least one layer of ink.

12. The luminaire housing of claim 7, wherein said bottom panel is planar and said first end cap and said second end cap each have a bottom surface substantially coplanar with said bottom panel.

13. The luminaire housing of claim 12, wherein a first end cap printed panel forms at least a portion of said bottom surface of said first end cap and a second end cap printed panel forms at least a portion of said bottom surface of said second end cap.

14. The luminaire housing of claim 13, wherein said first end cap printed panel and said second end cap printed panel are polycarbonate.

15. The luminaire housing of claim 14, wherein said first end cap printed panel and said second end cap printed panel each have a first surface generally facing the same general direction as said first surface of said bottom panel; and wherein said first surface of said first end cap printed panel and said first surface of said second end cap panel each have at least one opaque layer of ink applied thereto.

16. The luminaire housing of claim 15, wherein said at least one layer of ink applied to said first surface of said first end cap printed panel and said at least one layer of ink applied to said first surface of said second end cap printed panel is the same color as said at least one layer of ink applied to said first surface of said bottom panel.

17. An elongated luminaire housing, comprising:

a longitudinally extending luminaire housing frame surrounding an interior portion of said luminaire housing;

a light permeable polycarbonate panel coupled to said luminaire housing frame, said polycarbonate panel having a first surface generally facing said interior portion of said luminaire housing and a second surface opposite said first surface;

wherein said polycarbonate panel has an opaque printed layer applied to said first surface thereof;

wherein said opaque printed layer outlines at least one light permeable light passageway in said polycarbonate panel;

a diffuser panel adjacent said first surface of said polycarbonate panel, said diffuser panel covering said light permeable light passageway;

an end cap coupled to a first latitudinal end of said luminaire housing frame, said end cap having a polycarbonate printed end cap panel forming a bottom surface thereof, said polycarbonate printed end cap panel being substantially coplanar with said polycarbonate panel.

18. The elongated luminaire housing of claim 17, wherein said polycarbonate end cap printed panel has a first surface generally facing the same general direction as said first surface of said polycarbonate panel; and wherein said first surface of said end cap polycarbonate printed panel has at least one opaque layer of ink applied thereto.

19. The elongated luminaire housing of claim 18, wherein the entirety of said first surface of said polycarbonate printed end cap panel is covered with said at least one opaque layer of ink.

20. The elongated luminaire housing of claim 19, wherein said light passageway is a longitudinally extending light passageway surrounded by said opaque printed layer.

* * * * *